US007478734B2

(12) United States Patent
Vargas

(10) Patent No.: US 7,478,734 B2
(45) Date of Patent: Jan. 20, 2009

(54) COLLAPSIBLE CONTAINER

(76) Inventor: Edgar Hidalgo Vargas, Santa Barbara de Heredia, Cien metros al sur del Parque, San Jose (CR) 38-1150

( * ) Notice: Subject to any disclaimer, the term of this patent is extended or adjusted under 35 U.S.C. 154(b) by 632 days.

(21) Appl. No.: 11/113,209

(22) Filed: Apr. 25, 2005

(65) Prior Publication Data

US 2006/0237455 A1 Oct. 26, 2006

Related U.S. Application Data

(63) Continuation-in-part of application No. PCT/CR03/00001, filed on Sep. 4, 2003.

(51) Int. Cl.
*B65D 6/00* (2006.01)
*B65D 8/04* (2006.01)
*B65D 8/18* (2006.01)

(52) U.S. Cl. ..... 220/4.34; 220/692; 220/668

(58) Field of Classification Search ..... 220/668, 220/682, 691, 4.34, 692, 693
See application file for complete search history.

(56) References Cited

U.S. PATENT DOCUMENTS 6,631,821 B2 * 10/2003 Vourganas ..... 220/1.5

FOREIGN PATENT DOCUMENTS

DE 144916 7/1901

* cited by examiner

*Primary Examiner*—Anthony D Stashick
*Assistant Examiner*—Shawn M Braden
(74) *Attorney, Agent, or Firm*—Sanchelima & Assoc., P.A.

(57) ABSTRACT

A volumetric efficient collapsible and tamper proof container for protecting goods contained therein during transportation and storage. The container comprises six walls perpendicularly and hingedly mounted to each other to define a cubic space therein. Long and short elongated pins are passed through openings in knuckle extensions on the sides of the walls and they are cooperatively disposed to offset each opposite tubular member to permit the coaxial alignment of the respective through openings. Locking tubular members are used to keep one or more of the long pins in place. The long pins keep the shorter pins in place. Seal members are used to prevent the removal of one or more of the long pins that are keeping the short pins in place. The other long and short elongated pins are kept in place with locking tubular members that can only be removed when the walls are flat on a common plane.

2 Claims, 6 Drawing Sheets

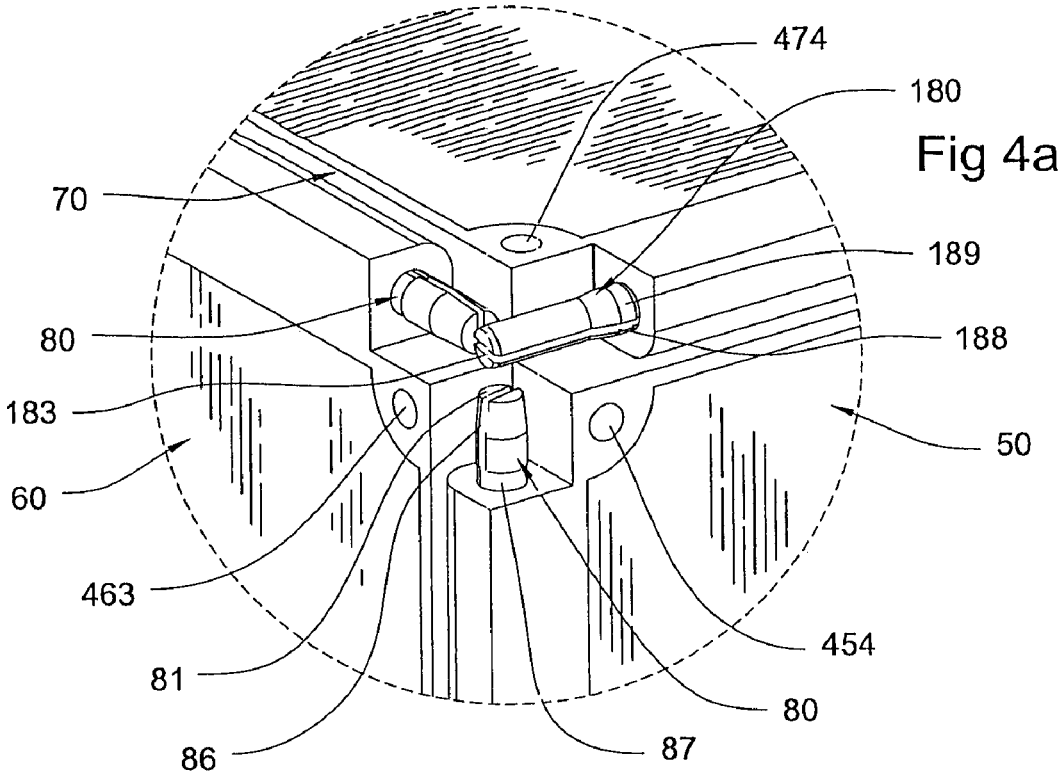
Fig 4a
Fig 6
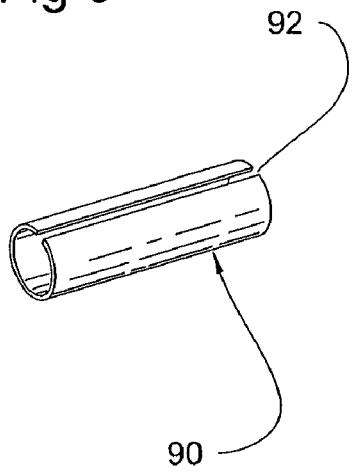
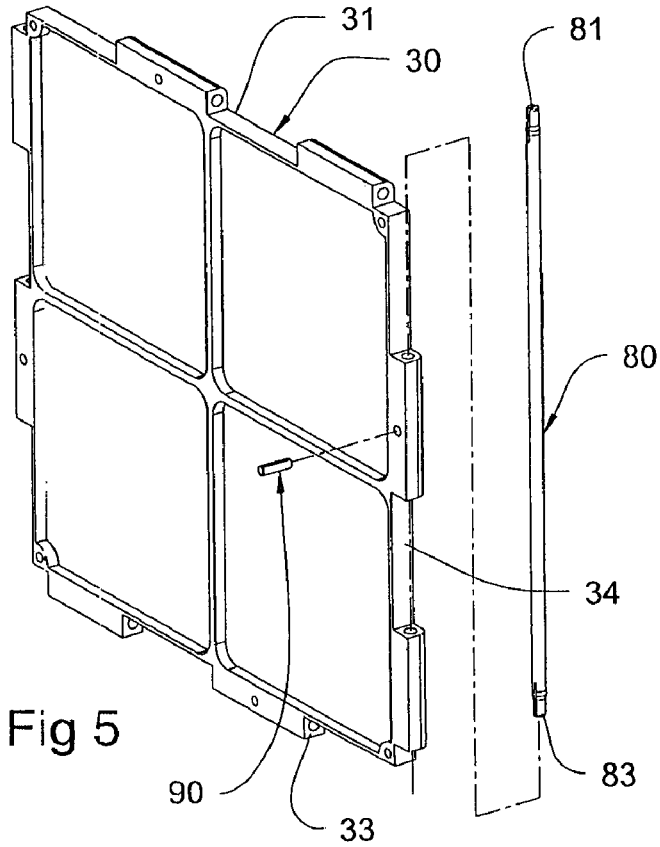
Fig 5

COLLAPSIBLE CONTAINER

I. OTHER RELATED APPLICATIONS

The present application is a continuation-in-part of pending of PCT Patent Application Ser. No. PCT/CR03/00001, filed on Sep. 4, 2003, which is hereby incorporated by reference.

II. BACKGROUND OF THE INVENTION

1. Field of the Invention

The present invention relates to a tamper proof collapsible container, and more particularly, to such a collapsible container that is volumetrically efficient for its transportation and storage.

2. Description of the Related Art

Several designs for collapsible containers have been designed in the past. None of them, however, discloses a simple design that utilizes a minimum number of elements to assemble while retaining its functions.

Applicant believes that the closest reference corresponds to the German patent No. 144916 issued to Publio Durant-Valentini on Jul. 18, 1901 for a collapsible container for transportation. However, it differs from the present invention because the present invention includes the use of coaxially aligned knuckles that are integrally built to the panels. The German patent, on the other hand, teaches the use of separate knuckles (see FIGS. 1 and 9) that require the use of fastening members to secure them to the panels. Second, the German patent discloses the use of pin assemblies, like in the present invention, but it does not disclose through openings that lockingly receive locking tubular members to keep the pin assemblies in place. The pin assemblies in the German patent are kept in place by using pin members of four different dimensions and shapes (b; F and the short and long pins) while the present invention only uses short and long pins. Additionally, the pin assemblies in the German patent have releasably mounted heads kept in place with locking clips, which make a difference with the pin assemblies of the present invention. Third, the present invention cannot be tampered with unless the security seal is broken. Also, the tubular members cannot be removed while the container is assembled. It requires disassembly of the top long pins (breaking the security seals) first before it can remove the vertical pins. Locking tubular members can only be pushed through to remove them when adjoining walls are in the same plane. When assembled, the locking tubular members are flush with the wall surface. Therefore, the locking pin cannot be removed from the outside. This facilitates the logistics for security, transporting and storing the containers when not in use. If the container disclosed in the German patent is disassembled, the pieces will be loose and require separate handling. With the present invention, a user can keep the panels of a disassembled container joined together. This feature constitutes a logistic advantage for storage, transportation and reassembly operations.

Another difference not shown in the German patent reference is that the present invention provides for plugs and cavities that are used to stack the containers vertically. In sum, the different features of the present invention resolve logistic problems with the storage and transportation of these containers that were not even considered by the German patentee, let alone disclosed in his 1903 patent.

Other patents describing the closest subject matter provide for a number of more or less complicated features that fail to solve the problem in an efficient and economical way. None of these patents suggest the novel features of the present invention.

III. SUMMARY OF THE INVENTION

It is one of the main objects of the present invention to provide a collapsible container that is volumetrically efficient for its transportation and storage.

It is another object of this invention to provide a collapsible container that includes substantially identical square walls perpendicularly disposed with respect to each other requiring a minimum of components and tools for assembly.

It is yet another object of this invention to provide such a container that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

FIG. 3*a* shows the assembly represented in the previous figure showing how the pins are introduced.

Figure 4:
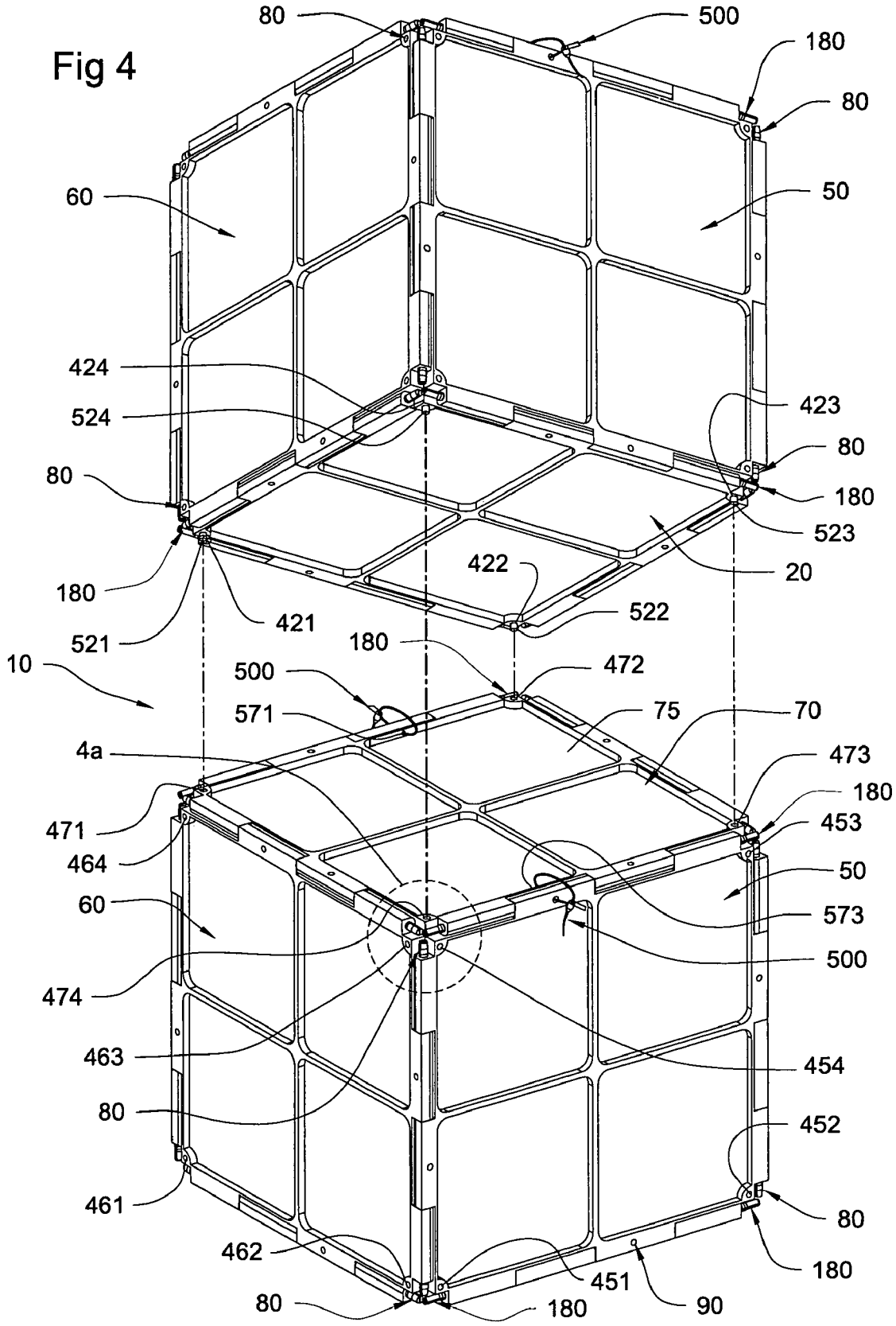

FIG. 4 is a representation of two containers in isometric views showing their alignment for stacking up using pin members to secure them in place.

FIG. 4*a* is a detail representation of one of the corners of the container, taken from portion 4*a* in FIG. 4.

FIG. 5 is an exploded isometric view of one of the lateral walls with an elongated pin assembly and a locking tubular member mounted thereto.

FIG. 6 is an enlarged isometric view of locking tubular member.

Figure 7:
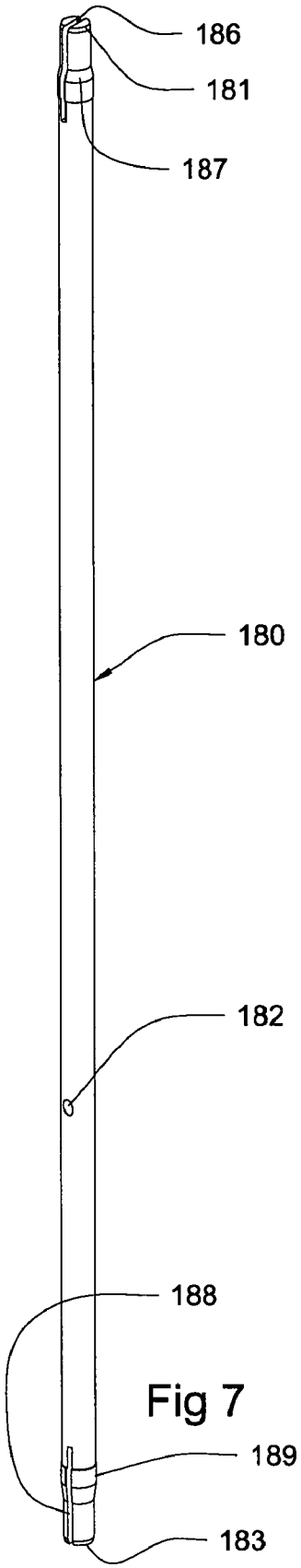

FIG. 7 is an enlarged isometric view of one of the four long pin members.

Figure 8:
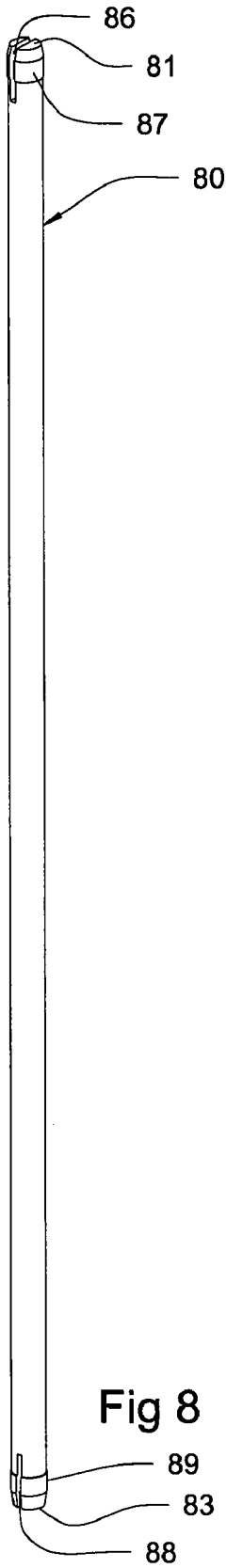

FIG. 8 is an enlarged isometric view of one of the short pin members.

Figure 9:
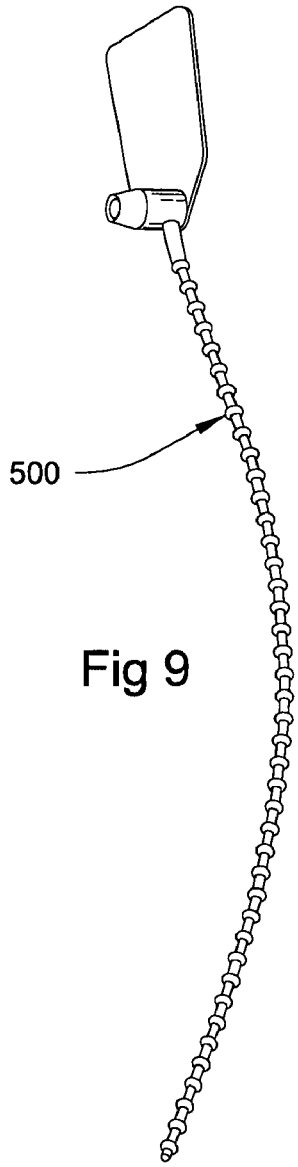

FIG. 9 is a detail view of one of the seal wire members used with the present invention.

V. DETAILED DESCRIPTION OF THE PREFERRED EMBODIMENT

Referring now to the drawings, where the present invention is generally referred to with numeral 10, it can be observed that it basically includes bottom wall 20, lateral walls 30; 40; 50; and 60, and top wall 70 perpendicularly mounted to each other and held in place with elongated pin assemblies 80 and 180 and kept in place with locking tubular members 90. An interior space is defined for housing goods that are protected during storage and/ or transportation.

Figure 1:
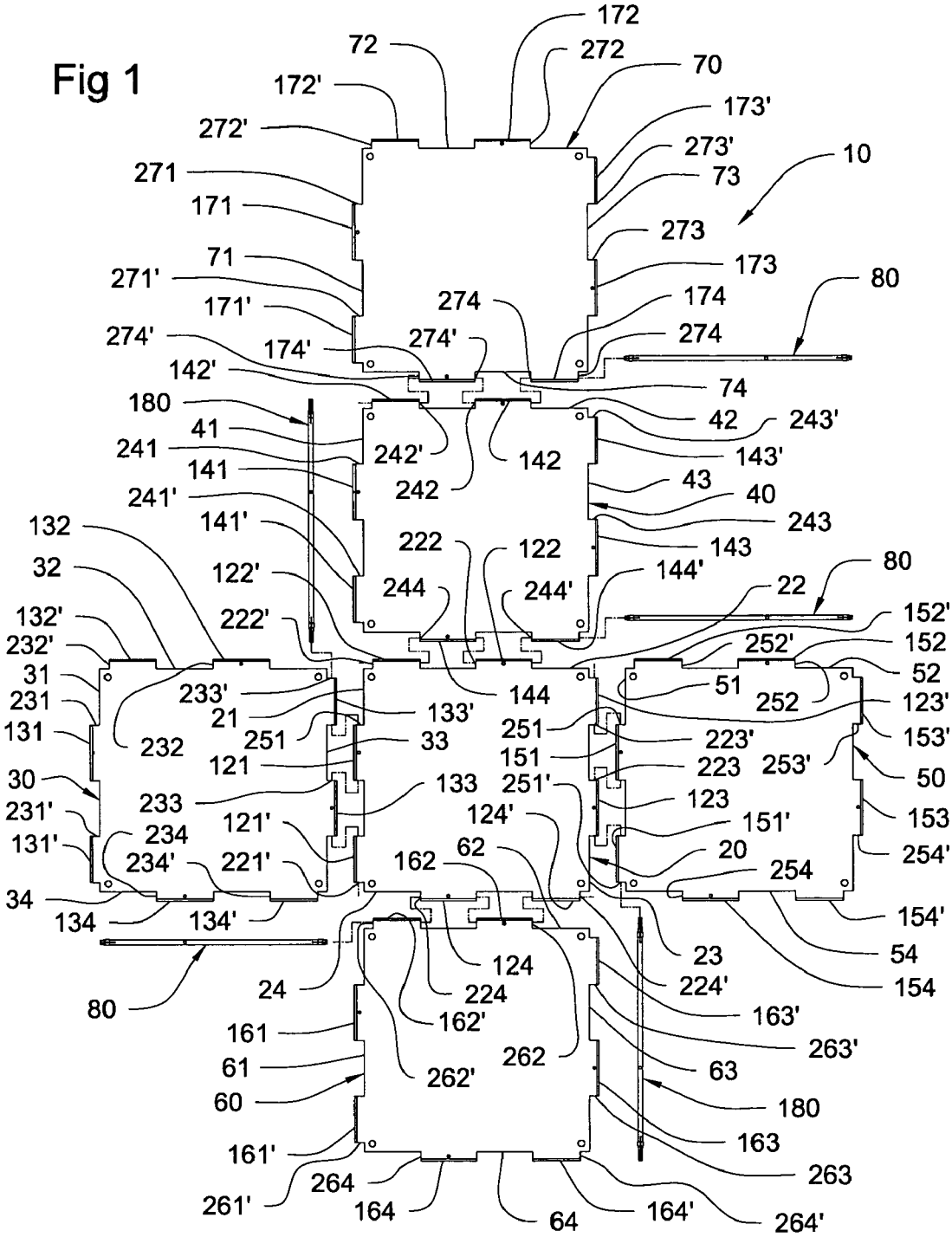
FIG. 1 represents a top view of the collapsible container subject of this application, disassembled.

Walls 20; 30; 40; 50; 60 and 70 are preferably identical and square. Bottom wall 20 has four straight longitudinal sides 21; 22; 23 and 24, lateral walls 30; 40; 50 and 60, as well as top wall 70 also have similar sides labeled as 31; 32; 33; 34; 41; 42; 43; 44; 51; 52; 53; 54; 61; 62; 63; 64; 71; 72; 73 and 74, as best seen in FIG. 1. Top wall 70 also has at least two depressed portions 75 and 76 that provide space for through openings 571 and 573. Walls 20; 30; 40; 50; 60 and 70 can be solid or include openings, depending on its intended contents and application. Walls 20; 30; 40; 50; 60 and 70 define an internal space when they are perpendicularly disposed with respect to each other, as best seen in FIG. 3*a*.

Figure 2:
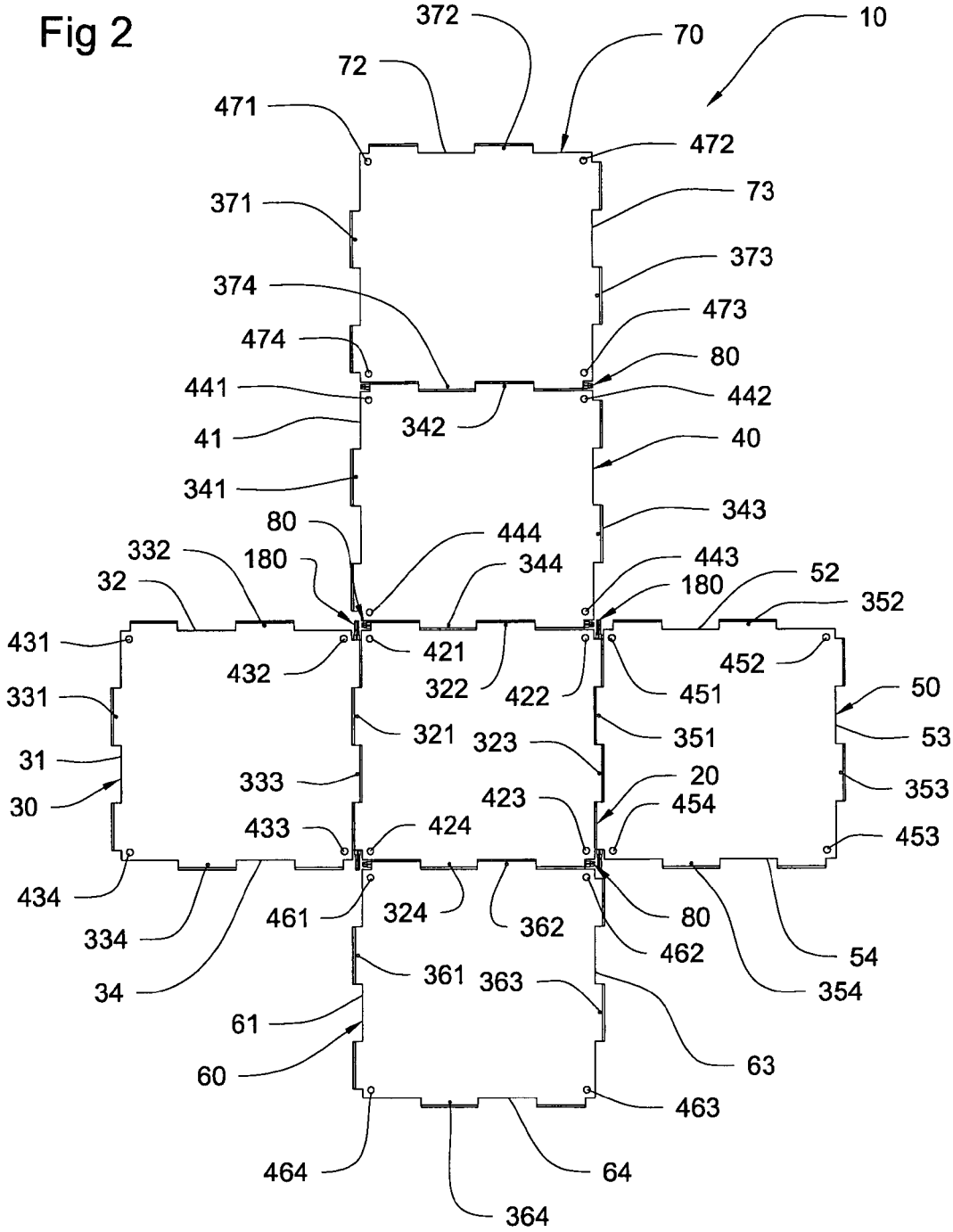
FIG. 2 shows the container represented in FIG. 1 with the bottom wall hingedly mounted to the lateral walls and cover wall hingedly mounted to one of the lateral walls.
Figure 3:
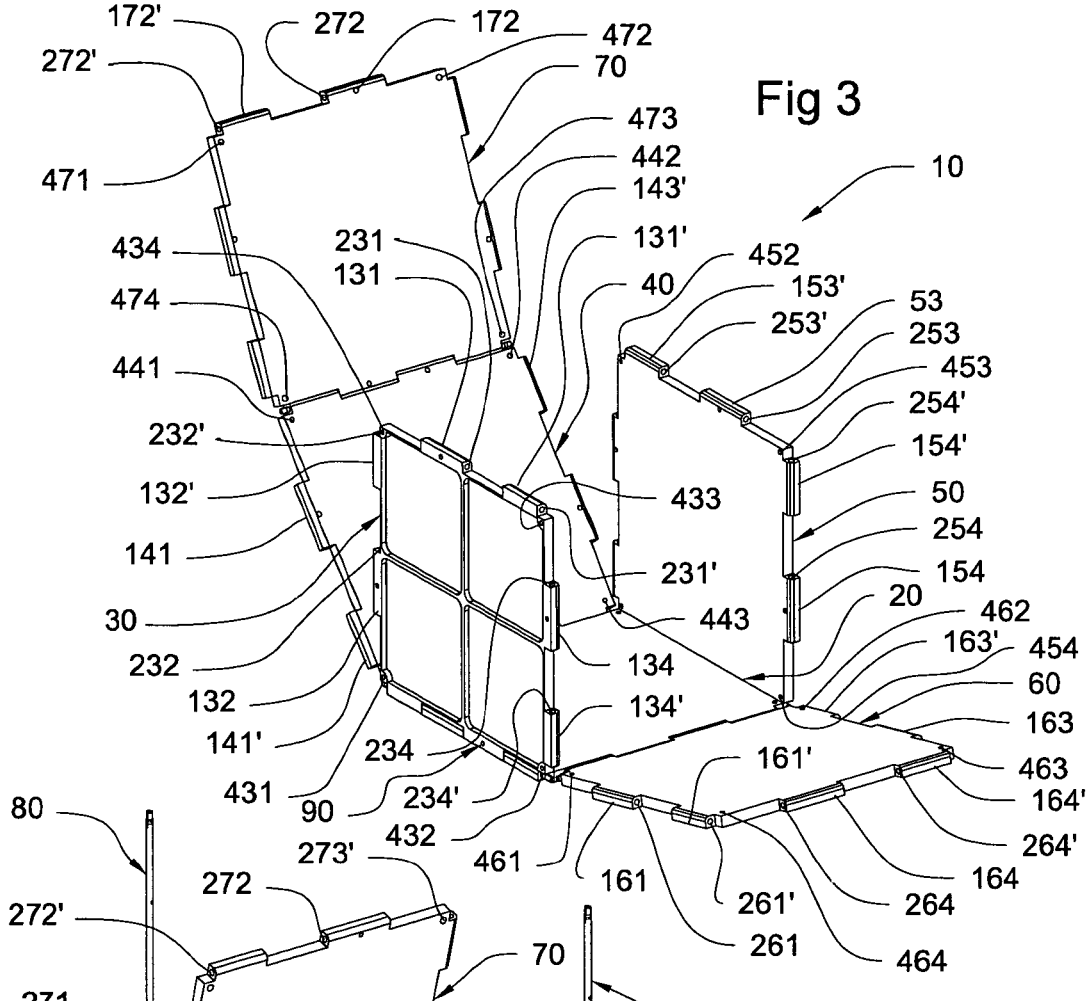
FIG. 3 illustrates the container shown in the previous figures being assembled.

Knuckle extensions 121; 121'; 122; 122'; 123; 123'; 124; 124'; 131; 131'; 132; 132'; 133; 133'; 134; 134'; 141; 141'; 142; 142'; 143; 143'; 144; 144' 151; 151'; 152; 152'; 153; 153'; 154; 134'; 161; 161'; 162; 162'; 163; 163'; 164; 164'; 171; 171'; 172; 172'; 173; 173'; 174 and 174' are associated with each side for walls 20; 30; 40; 50; 60 and 70, as best seen in FIG. 1. The knuckle extensions associated with a particular side are substantially identical in the preferred embodiment and coaxially aligned. They are separated from each other with complementing spaces that cooperate to receive knuckle extension from contiguous walls that are brought in coaxial alignment to permit pin assemblies 80 and 180 to go through. As best seen in FIGS. 3 and 3*a*, knuckle extensions 121; 121'; 122; 122'; 123; 123'; 124; 124'; 131; 131'; 132; 132'; 133; 133'; 134; 134'; 141; 141'; 142; 142'; 143; 143'; 144; 144' 151; 151'; 152; 152'; 153; 153'; 154; 134'; 161; 161'; 162; 162'; 163; 163'; 164; 164'; 171; 171'; 172; 172'; 173; 173'; 174 and 174' include longitudinal through openings 221; 221'; 222; 222'; 223; 223'; 224; 224'; 231; 231'; 232; 232'; 233; 233'; 234; 234'; 241; 241'; 242; 242'; 243; 243'; 244; 244' 251; 251'; 252; 252'; 253; 253'; 254; 234'; 261; 261'; 262; 262'; 263; 263'; 264; 264'; 271; 271'; 272; 272'; 273; 273'; 274 and 274' that cooperative receive pin assemblies 80 therethrough. As best seen in FIG. 2, knuckle extensions 121; 122; 123; 124; 131; 132; 133; 134; 141; 142; 143; 144; 151; 152; 153; 154; 161; 162; 163; 164; 171; 172; 173 and 174 include transversal through openings 321; 322; 323; 324; 331; 332; 333; 334; 341; 342; 343; 344; 351; 352; 353; 354; 361; 362; 363; 364; 371; 372; 373 and 374 that permit locking tubular members 90 to go through.

As shown in FIG. 6, locking tubular member 90 has a longitudinal slot 92 that permits its temporary compression when it is inserted inside a transversal through opening. Member 90 has cooperative dimensions to fit flush with the surface of the knuckle extensions. In this manner, members 90 can only be removed by pushing them in when bottom wall 20, top wall 70 or lateral walls 30; 40; 50 and 60 are in the same plane. If perpendicularly disposed, members 90 cannot be pushed or pulled out.

Collapsible container 10 includes short pins 80 and long pins 180. As best seen in FIG. 4, four long pins are mounted to the junction of walls 20 with 50; 20 with 30; 50 with 70 and 30 with 70. For the other junctions of collapsible container 10, short pins 80 are used. As shown in FIG. 8, short pin assembly 80 includes wider portions 87 and 89 adjacent to the ends of 81 and 83, respectively. Slots 86 and 88 permit ends 81 and 83 to go through, so wider portions 87 and 89 cammingly compress when one of them is going through coaxially aligned knuckle members and expand once it exits. Once pin 80 is mounted to coaxially aligned knuckle members, wider portions 87 and 89 expand preventing any further longitudinal movement. In FIG. 7, the details of long pin assemblies 180 can be seen. In the preferred embodiment slots 186 and 188 at ends 181 and 183, respectively, permit a user to rotate pin assembly 180 to align its transversal through hole 182 with the corresponding opening of the knuckle members. Long pin assembly 180 includes wider portions 187 and 189 adjacent to the ends of 181 and 183, respectively. Slots 186 and 188 also permit ends 181 and 183 to go through, so wider portions 187 and 189 cammingly compress when one of them is going through coaxially aligned knuckle members and expand once they exit. Once pin 180 is mounted inside coaxially aligned knuckle members, wider portions 187 and 189 expand preventing any further longitudinal movement, as best shown in FIG. 4*a*.

As shown in FIGS. 5 and 6, a locking tubular member 90 is used to keep pin 180 in place. In the preferred embodiment, member 90 has a longitudinal slot 92 that permits its resilient compression to snuggly fit transversal through hole 182 and corresponding transversal through openings 321 or 333; 323 or 351; 331 or 371 and 353 or 373 thereby keeping the perpendicularly mounted walls at a fixed position and locking pin 180 in place.

As shown in FIG. 2, cavities 421; 422; 423; 424; 431; 432; 433; 434; 441; 442; 443; 444; 451; 452; 453; 454; 461; 462; 463; 464; 471; 472; 473 and 474, are located in the corners of walls 20; 30; 40; 50; 60 and 70, respectively. As best seen in FIG. 4, pins 521; 522; 523 and 524 are removably mounted to cavities 421; 422; 423 and 424 of bottom wall 20 and extend perpendicularly outwardly and are receivable within cooperating cavities 471; 472; 473 and 474 of top wall 70 on the lower collapsible container 10. When containers 10 are stacked on top of each other, the interlocking action of pins 521; 522; 523 and 524 and cavities 471; 472; 473 and 474 reduce lateral movements enhancing the integrity of the resulting structure. Optionally, additional pins could be cooperatively mounted to lateral walls to reduce movement between the horizontally contiguous containers 10.

To assemble container 10, a user starts with bottom wall 20 on a horizontal supporting surface and positioning lateral walls 30; 40; 50 and 60 adjacent to sides 21; 22; 23 and 24, respectively. Then, top wall 70 is placed adjacent to one of the lateral walls, for example, adjacent to side 42 of wall 40, as shown in FIG. 1. Two short pins 80 are passed through longitudinal through openings 222; 222' 244 and 244' and 224; 224' 262 and 262' hingedly connecting bottom wall 20 to lateral walls 40 and 60. Two long pins 180 are passed through longitudinal through openings 221; 221' 233 and 233' and 223; 223' 251 and 251' hingedly connecting bottom wall 20 to lateral walls 30 and 50. Then, top wall 70 is hingedly mounted to lateral wall 40 by passing one short pin 80 through openings 242; 242' 274 and 274'. Next, a user brings the lateral walls to a perpendicular relationship with the bottom walls and inserts locking tubular members 90 through transversal opening 321 or 333 and through transversal opening 323 or 351, locking long pins 180. Then, four short pins 80 are passed through openings 232; 232'; 241; 241' and 243; 243'; 252; 252' and 254; 254'; 263; 263' and 234; 234'; 261; 261' thereby ensuring that lateral walls 30; 40; 50 and 60 will stay in perpendicular relationship with respect to bottom wall 20, as best seen in FIGS. 3 and 3*a*. The cubic block is ten formed by bringing through openings 272 and 272' in coaxial alignment with through openings 264 and 264' and passing another short pin 80 therethrough. Finally, two long pins 180 are passed through aligned longitudinal through openings 231; 231' 271 and 271' and 253; 253' 273 and 273' connecting top wall 70 to lateral walls 30 and 50.

Seal wire member 500 is inserted through openings 571 and 573, through openings 371 and 373 and transversal holes 182 of pin assemblies 180.

Once collapsible container 10 reaches its destination, the receiver brakes seal wire members 500, remove long pins 180 from the top wall, removes pin 80 from through openings 272; 272'; 264 and 264' and empty its merchandise. Then, the receiver removes the four short pins 80 from through openings 232; 232'; 241; 241' and 243; 243'; 252; 252' and 254; 254'; 263; 263' and 234; 234'; 261; 261' so walls 20; 30; 40; 50; 60 and 70 return to the same plane as shown in FIG. 2. Removed pins 80 and 180 are inserted to the knuckle extensions of walls 30; 40; 50; 60 and 70. At this disposition, several collapsible containers 10 can be more efficiently stacked to return them to its original place.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A collapsible container, comprising:

A) first, second, third, fourth, fifth and sixth substantially square walls, each having first, second, third and fourth longitudinal sides substantially identical in length and said first and said second sides being parallel and apart from each other and said third and fourth sides are kept at a separate and apart relationship with respect to each other, said first and second sides being perpendicular to said third and fourth sides and each of said first, second, third and fourth longitudinal sides including first and second knuckle extensions, respectively, mounted longitudinally thereon, each of said first and second knuckle extensions including a longitudinal through opening, said first and second knuckle extensions being separated by a predetermined distance with respect to each other, said first and second knuckle extensions on said first and third sides being offset with respect to said first and second knuckle extensions of said second and fourth sides so that said longitudinal through openings of said first and second knuckle extensions of said first and third sides can be coaxially aligned with said first and second knuckle extensions of said second and fourth sides, respectively, thereby defining an internal space when said first, second third, fourth, fifth and sixth walls are perpendicularly disposed with respect to each other;

B) first, second, third, fourth, fifth, sixth, seventh and eighth short pin members removably receivable through said longitudinal through openings of said first and second knuckle extensions, said first and second short pin members hingedly joining said first wall to said second and third walls, said third, fourth, fifth and sixth short pin members hingedly joining said second, third, fourth and fifth walls defining a square that is perpendicularly disposed with respect to said first wall, and said seventh and eighth short pin member hingedly joining said sixth wall to said second and third walls thereby defining a cube;

C) first, second, third and fourth long pin member having a length longer than said short pin member by a predetermined distance, said first and second long pin member hingedly joining said first wall to said fourth and fifth walls, thereby blocking the movement of said first and second short pin members, said third and fourth long pin members hingedly mounting said sixth wall to said fourth and fifth walls thereby blocking the movement of said seventh and eighth short pin members wherein each of said long pin members include at least one through hole, said first and second knuckle extension include at least one transversal through opening cooperatively disposed in alignment with said at least one through hole when said long pin member is housed within said longitudinal through opening and said means for keeping said long pin members in place further includes at least one locking tubular member insertable within said at least one of said through holes of said first and second long pin members and through said at least one transversal through opening of said first and second knuckle extensions housing them thereby keeping said first and second long pin members in place and said means for keeping said long pin members in place further including seal wire means passing through said at least one through hole of said third and fourth long pin member and said at least one through opening housing them thereby keeping said third and fourth long pin members in place; and D) means for keeping said long pin members in place within said knuckle extensions.

2. The collapsible container set forth in claim 1 wherein said locking tubular members include a longitudinal slot to impart resiliency to said locking tubular member and having cooperative dimensions to snugly fit inside said through holes and said through openings being flush with the surface of said knuckle extensions so that said locking tubular members cannot be removed when the walls of said knuckle extensions are perpendicular to each other.

* * * * *